US006685040B2

(12) United States Patent
Heinisch et al.

(10) Patent No.: US 6,685,040 B2
(45) Date of Patent: Feb. 3, 2004

(54) ENERGY-ABSORBING DEVICE FOR THE END OF RAIL VEHICLES

(75) Inventors: Andreas Heinisch, Rethen (DE); Eckart Jäde, Braunschweig (DE); Frank Reineck, Salzgitter (DE)

(73) Assignee: Voith Turbo Scharfenberg GmbH & Co. KG, Salzgitter (DE)

( * ) Notice: Subject to any disclaimer, the term of this patent is extended or adjusted under 35 U.S.C. 154(b) by 0 days.

(21) Appl. No.: 10/159,168

(22) Filed: May 30, 2002

(65) Prior Publication Data

US 2002/0178967 A1 Dec. 5, 2002

(30) Foreign Application Priority Data

May 31, 2001 (DE) ..... 101 26 483

(51) Int. Cl.[7] ..... B61D 17/00

(52) U.S. Cl. ..... 213/221; 213/220; 213/63; 105/392.5

(58) Field of Search ..... 213/220, 221, 213/222, 223, 63, 64, 62 A, 74; 105/392.5, 394

(56) References Cited

U.S. PATENT DOCUMENTS 2,213,455 A * 9/1940 Abkowitz ..... 213/9
2,287,954 A * 6/1942 Wolfe ..... 213/4
3,008,746 A * 11/1961 Senger ..... 213/223
3,367,515 A * 2/1968 Clejan ..... 213/22
4,049,129 A * 9/1977 Bergs ..... 213/4
4,576,294 A * 3/1986 Forster ..... 213/9
5,472,104 A * 12/1995 Domsgen ..... 213/4
6,158,356 A * 12/2000 Hachet et al. ..... 105/392.5

FOREIGN PATENT DOCUMENTS

| | | |
|---|---|---|
| DE | 195 02 217 A1 | 10/1996 |
| DE | 197 05 226 A1 | 8/1998 |
| DE | 198 17 861 A1 | 10/1999 |
| DE | 199 56 856 A1 | 5/2001 |
| EP | 0 858 937 A2 | 8/1998 |

* cited by examiner

*Primary Examiner*—Mark T. Le
(74) *Attorney, Agent, or Firm*—McGlew and Tuttle, P.C.

(57) ABSTRACT

An energy-absorbing device for the end of rail vehicles is provided. In order in particular to reduce the cost of adaptation and matching between vehicle manufacturers and suppliers of the energy-absorbing device and the couplings (3) and the design and/or quality risks, the energy-absorbing device exhibits a base frame (1) which carries all the proposed elements for energy absorption in the end area and which is fastened as a compact preassembled module to the sub-frame (9) entirely in the defined interface area.

20 Claims, 1 Drawing Sheet

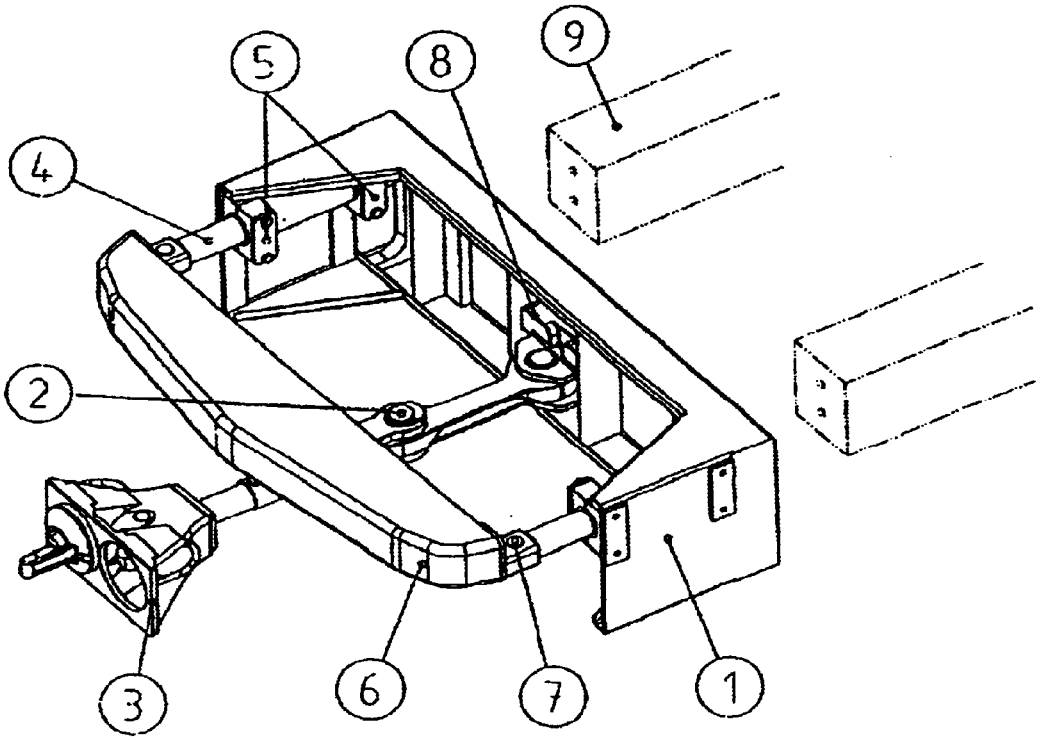
9
5
8
4
2
3
6
7
1

ENERGY-ABSORBING DEVICE FOR THE END OF RAIL VEHICLES

FIELD OF THE INVENTION

The invention relates to an energy-absorbing device for the end of rail vehicles.

BACKGROUND OF THE INVENTION

From DE 195 02 217 A1 it is known for example for multi stage energy-absorbing devices to be arranged in the sub-frame area of rail vehicles. These exhibit a reversible energy absorbing device as primary stage which in the form of an elastomer cartridge is integrated in the shaft of a central buffer coupling and is designed to absorb the impact forces occurring during journeys and shunting. The shaft itself can be fastened to the sub-frame by means of an elastomer spring joint (elastic/reversible energy absorption) and possibly by means of breaking elements (inelastic/irreversible energy consumption through deformation energy).

A second secondary energy-absorbing device for absorption of impact energies arising from excessive impacts is arranged in the form of two side buffers, possibly with climbing guards on the outer edge of the end.

A further energy-absorbing device for rail vehicles is known for example from EP 858 937 A2 in which after exhaustion of the energy-absorbing capacity of a primary energy-absorbing device working reversibly on the coupling shaft of a central buffer coupling, a second energy absorbing device ensures further impact and energy dissipation through a force-directing element, e.g. a buffer which is set back.

Until now, the energy-absorbing devices named previously have been developed and adapted individually for each vehicle and integrated into the vehicle as individual elements. The result is a large number of interfaces with the vehicle, combined with high matching and adaptation costs with a variety of technical risks. A rigid random interface specification frequently leads to complicated or uneconomical solutions. Even with the same kind of design principles, for every new order this leads to a new product with high one-off development costs, additional procurement and storage costs, commissioning costs, and regularly to new technical risks and to major quality risks.

SUMMARY OF THE INVENTION

Therefore, the underlying object of the invention is to create an energy-absorbing device which reduces the costs of adaptation and matching between the vehicle manufacturer and the supplier of the energy-absorbing device or coupling and the design and/or quality risks.

According to the invention, an energy-absorbing device for the end of rail vehicles exhibiting a base frame is provided which carries all the proposed elements for energy absorption in the end area. The base frame which carries all the proposed elements for energy absorption is fastened as a compact pre-assembled module to the sub-frame of the rail vehicle with the connection entirely in a defined interface area.

The vehicle coupling may be fastened to the base frame through a coupling mounting. Side energy-absorbing elements may be arranged on the base frame on both sides. The side energy-absorbing elements may be of regenerative design. The side energy-absorbing elements may be joined by a bumper bar which extends essentially horizontally. The bumper bar may be located in the horizontal plane of the coupling. The bumper bar can be put out of operation in a resting position, in particular by manual removal or by swivelling it upwards or downwards. The bumper bar may be designed so that it can be moved into and out of the resting position manually, automatically or with power assistance.

The vehicle coupling may be embodied so that it can be set back behind the bumper bar inside the end profile of the vehicle, in particular by swivelling, telescoping, buckling or the like. The base frame may be provided and integrated in the sub-frame of the rail vehicle as a static load-bearing element.

The modular construction of the energy/absorbing device is perfectly in keeping with the trend to platform vehicles with a different front design in the rail vehicle industry and this guarantees rapid installation and interchangeability. The technical and financial risks are minimized by substantial reduction of the interfaces and the extensive use of tried and tested standard components which are adapted to the performance requirements but independent of a particular vehicle.

The invention is explained in greater detail in the following with reference to an embodiment example.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The drawing is a perspective illustration of the energy-absorbing device according to the invention.

DESCRIPTION OF THE PREFERRED EMBODIMENT

Referring to the drawings in particular, the energy-absorbing device according to the invention is fastened to the end of rail vehicles by means of a base frame 1. The base frame 1 contains and carries all the proposed elements of the energy-absorbing device and is fastened as a compact, pre-assembled module to the sub frame 9 in the interface area of the rail vehicle. In addition, a coupling 3, embodied as a center coupling or center buffer coupling, is fastened in the vertical longitudinal median plane of the base frame 1 or rail vehicle by means of a coupling mounting 8 which essentially guarantees the necessary horizontal deflections, but as a rule also elastically supports the vertical and cardanic deflections occurring in service (elastomer spring joint).

A side energy-absorbing element 4, which is preferably of regenerative design, is arranged on either side of the base frame 1. The energy-absorbing elements 4 are fastened by brackets 5 on the side of the base frame 1 and joined to one another by a bumper bar 6 which essentially extends horizontally. The energy-absorbing elements 4 are attached to the bumper bar 6 by means of an adapter 7 in each case.

The bumper bar 6 is arranged above the horizontal plane of the coupling in the embodiment example in FIG. 1, but can also be provided in the horizontal plane of the coupling.

For designs according to the embodiment example, the bumper bar 6 is usually connected securely to the side energy-absorbing elements 4 through the adapters 7. The coupling 3 is designed so that it can be set back behind the bumper bar 6 inside the vehicle profile. The coupling 3 can be set back in particular by manual or automated swivelling, telescoping or buckling of the coupling rod in a joint 2 and is often required or desirable for safety reasons for the free uncoupled end of a rail vehicle 1, in particular for trams which at least in part share the road with other road users. An additional coupling flap can be provided to cover the end of the free space in the area of the coupling under the bumper bar 6. The coupling flap can be designed so that it can be detached manually or swivelled manually 5 or automatically for example.

For designs in which the bumper bar 6 is arranged in the horizontal plane of the coupling, the bumper bar 6 can be put out of operation in a resting position, in particular by manual removal or by swivelling it downwards or upwards. The bumper bar 6 has to be moved out of the horizontal plane of the coupling in order to be able to move the coupling 3 out of the resting position into the working position. when the end of the rail vehicle concerned is to be made ready for coupling.

The bumper bar 6 is moved into the resting position and the coupling 3 is moved into the working position automatically (e.g. by means of an electric motor), manually or with power assistance (e.g. pressurized gas spring).

The base frame 1 with the energy-absorbing device and the coupling 3 can be fastened as a pre-assembled complete energy-absorbing and coupling module to the sub-frame 9 of the rail vehicle through a defined unified interface.

The base frame 1 can be provided and integrated in the subframe 9 of the vehicle as a static load-bearing element.

While specific embodiments of the invention have been shown and described in detail to illustrate the application of the principles of the invention, it will be understood that the invention may be embodied otherwise without departing from such principles.

APPENDIX

References

1. Base frame
2. joint
3. Coupling
4. Energy-absorbing element
5. Bracket
6. Bumper bar
7. Adapter
8. Coupling mounting
9. Sub-frame

What is claimed is:

1. An energy-absorbing device for the end of a rail vehicle with a subframe with a vertically arranged front wall interface area, the device comprising:

a base frame;

an energy absorbing arrangement connected only to said base frame; and a vehicle coupling fastened to said base frame through a coupling mounting, wherein said energy absorbing arrangement cooperates with said base frame to form a pre-assembled module and is fastened as a compact pre-assembled module only to the vertically arranged front wall interface area of the sub-frame of the rail vehicle.

2. An energy-absorbing device according to claim 1, wherein said energy absorption arrangement includes side energy-absorbing elements arranged on the base frame on both sides.

3. An energy-absorbing device according to claim 2, wherein the side-energy absorbing elements are regenerative side energy-absorbing elements.

4. An energy-absorbing device according to claim 2, wherein the side energy-absorbing elements are joined by a bumper bar which extends essentially horizontally.

5. An energy-absorbing device according to claim 4, wherein the bumper bar is located in a horizontal plane of the coupling.

6. An energy-absorbing device according to claim 4, wherein the bumper bar can be put out of operation in a resting position.

7. An energy-absorbing device according to claim 6, wherein the bumper bar has mounting supports so that it can be moved into and out of the resting position.

8. An energy-absorbing device according to claim 1, wherein the vehicle coupling is embodied so that it can be set back behind the bumper bar inside the end profile of the vehicle.

9. An energy-absorbing device according to claim 1, wherein the base frame is provided and integrated in the sub-frame of the rail vehicle as a static load-bearing element.

10. An energy-absorbing device for the end of rail vehicles having a sub-frame interface area, the device comprising:

a base frame;

a bumper and an energy absorption means for absorption of forces applied to the bumper, said energy absorption means being connected exclusively to said base frame; and a vehicle coupling fastened to said base frame through a coupling mounting, wherein said energy absorption means cooperating with said base frame and said bumper to form a pre-assembled module is fastened as a compact pre-assembled module only to the vertically arranged front wall interface area of the sub frame of the rail vehicle.

11. An energy-absorbing device according to claim 10, wherein said energy absorption arrangement includes side energy-absorbing elements arranged on the base frame on both sides.

12. An energy-absorbing device according to claim 11, wherein the side energy-absorbing elements are regenerative side energy-absorbing elements.

13. An energy-absorbing device according to claim 11, wherein the side energy-absorbing elements are joined by a bumper bar which extends essentially horizontally.

14. An energy-absorbing device according to claim 13, wherein the bumper bar is located in a horizontal plane of the coupling.

15. An energy-absorbing device according to claim 13, wherein the bumper bar can be put out of operation in a resting position.

16. An energy-absorbing device according to claim 15, wherein the bumper bar is designed so that it can be moved into and out of the resting position.

17. An energy-absorbing device according to claim 10, wherein the vehicle coupling is embodied so that it can be set back behind the bumper bar inside the end profile of the vehicle.

18. An energy-absorbing device according to claim 10, wherein the base frame is provided and integrated in the sub-frame of the rail vehicle as a static load-bearing element.

19. A rail vehicle comprising:

a sub frame with an interface surface extending substantially in a vertical plane;

a base frame mounted to said sub frame;

an energy absorbing element mounted to said base frame;

a bumper bar mounted to said energy absorbing element; and a coupling with a coupling linkage, said coupling linkage being mounted directly to said base frame.

20. An energy absorbing device according to claim 19, wherein said coupling is movable between a stored position and a deployed position, and said bumper bar is a movable between an operational position and a non-operational position with said bumper bar obstructing a deployment of said coupling from said stored position to said deployed position when said bumper bar is in said operational position, and said bumper bar not obstructing a deployment of said coupling from said stored position to said deployed position when said bumper bar is in said non-operational position.

* * * * *